US007459843B2

(12) United States Patent
Hwang

(10) Patent No.: US 7,459,843 B2
(45) Date of Patent: Dec. 2, 2008

(54) ELECTRON EMISSION DEVICE WITH MULTILAYERED INSULATING LAYERS

(75) Inventor: Seong-Yeon Hwang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 51 days.

(21) Appl. No.: 11/348,570

(22) Filed: Feb. 6, 2006

(65) Prior Publication Data

US 2006/0238108 A1 Oct. 26, 2006

(30) Foreign Application Priority Data

Feb. 28, 2005 (KR) ..... 10-2005-0016859

(51) Int. Cl.
*H01J 1/62* (2006.01)
*H01J 1/46* (2006.01)

(52) U.S. Cl. ..... 313/495; 313/497; 313/293

(58) Field of Classification Search ..... None
See application file for complete search history.

(56) References Cited

U.S. PATENT DOCUMENTS 5,264,758 A 11/1993 Iijima et al.
5,653,619 A * 8/1997 Cloud et al. ..... 445/24
5,936,343 A 8/1999 Fushimi et al.
5,965,972 A * 10/1999 Takada et al. ..... 313/309
5,981,404 A * 11/1999 Sheng et al. ..... 438/791
6,062,931 A 5/2000 Chuang et al.
6,066,507 A * 5/2000 Rolfson et al. ..... 438/20
6,097,138 A 8/2000 Nakamoto
6,144,153 A 11/2000 Nakatani
6,400,091 B1 6/2002 Deguchi et al.
6,583,549 B2 6/2003 Takenaka et al.
6,621,232 B2 9/2003 Jo et al.
6,756,729 B1 6/2004 Na et al.
6,791,278 B2 9/2004 Russ et al.
2002/0017875 A1 2/2002 Lee et al.

(Continued)

FOREIGN PATENT DOCUMENTS

KR 2001-0046803 6/2001

(Continued)

OTHER PUBLICATIONS

CRC materials science and engineering handbook / [edited by] James F. Shackelford,□□William Alexander.—3rd ed., 2001, Tables 291 & 292.*

(Continued)

*Primary Examiner*—Karabi Guharay
*Assistant Examiner*—Britt Hanley
(74) *Attorney, Agent, or Firm*—Christie, Parker & Hale, LLP

(57) ABSTRACT

An electron emission device includes first and second substrates facing each other with a predetermined distance therebetween, and an electron emission region formed on the first substrate. First and second electrodes are placed on the first substrate while being insulated from each other to control an electron emission of the electron emission region. An insulating layer is disposed between the first and second electrodes. An anode electrode is formed on the second substrate. A phosphor layer is formed on a surface of the anode electrode. The insulating layer has a multiple-layered structure including at least two layers differing from each other in electro-physical property.

22 Claims, 8 Drawing Sheets

U.S. PATENT DOCUMENTS

| | | | | |
|---|---|---|---|---|
| 2002/0036460 | A1 | 3/2002 | Takenaka et al. | |
| 2002/0079802 | A1* | 6/2002 | Inoue et al. | 313/309 |
| 2004/0124762 | A1 | 7/2004 | Fushimi | |
| 2004/0227452 | A1* | 11/2004 | Lee et al. | 313/495 |
| 2006/0022577 | A1* | 2/2006 | Kim | 313/497 |
| 2007/0222357 | A1* | 9/2007 | Dijon et al. | 313/311 |

FOREIGN PATENT DOCUMENTS

| | | |
|---|---|---|
| KR | 2002-0078977 | 10/2002 |

OTHER PUBLICATIONS

K. Edinger, J. Melngailis, and J. Orloff , Study of precursor gases for focused ion beam insulator deposition, Journal of Vacuum Science & Technology B: Microelectronics and Nanometer Structures—Nov. 1998—vol. 16, Issue 6, pp. 3311-3314.* http://www.siliconfareast.com/sio2si3n4.htm, Properties of SiO2 and Si3N4 at 300K; retrieved on Aug. 31, 2007.*

Korean Patent Abstract, Publication No. 1020010046803 A, Published Jun. 15, 2001, in the name of Seok Yun Han, et al.

Korean Patent Abstract, Publication No. 1020020078977 A, Published Oct. 19, 2002, in the name of Jae Cheol Cha, et al.

* cited by examiner

ELECTRON EMISSION DEVICE WITH MULTILAYERED INSULATING LAYERS

CROSS REFERENCE TO RELATED APPLICATION

This application claims priority to and the benefit of Korean Patent Application No. 10-2005-0016859, filed on Feb. 28, 2005, in the Korean Intellectual Property Office, the entire content of which is incorporated herein by reference.

BACKGROUND OF THE INVENTION

1. Field of the Invention

The present invention relates to an electron emission device, and in particular, to an electron emission device which has an improved insulation structure disposed on a substrate between driving electrodes to insulate them from each other.

2. Description of Related Art

Generally, electron emission devices are classified into those using hot cathodes as the electron emission source, and those using cold cathodes as the electron emission source. There are several types of cold cathode electron emission devices, including a field emitter array (FEA) type, a surface-conduction emission (SCE) type, a metal-insulator-metal (MIM) type, and a metal-insulator-semiconductor (MIS) type.

The MIM-type electron emission device has an election emission region with a metal-insulator-metal (MIM) structure, and the MIS-type electron emission device has an electron emission region with a metal-insulator-semiconductor (MIS) structure. When voltages are applied to the two metals or the metal and the semiconductor on either side of the insulator, electrons migrate from the high electric potential metal or semiconductor to the low electric potential metal, and are accelerated.

The SCE-type electron emission device includes first and second electrodes formed on a substrate while facing each other, and a conductive thin film disposed between the first and the second electrodes. Micro-cracks are made at the conductive thin film to form electron emission regions. When voltages are applied to the electrodes while making the electric current flow to the surface of the conductive thin film, electrons are emitted from the electron emission regions.

The FEA-type electron emission device is based on the principle that when a material having a low work function or a high aspect ratio is used as an electron emission source, electrons are easily emitted from the material due to the electric field in a vacuum atmosphere. A front sharp-pointed tip structure based on molybdenum (Mo) or silicon (Si), or a layer formed with a carbonaceous material, such as carbon nanotube, graphite and/or diamond-like carbon, has been developed to be used as an electron emission region of the FEA-type electron emission device.

Although the electron emission devices are differentiated in their specific structure depending upon the types thereof, they all basically have first and second substrates forming a vacuum vessel (or a vacuum chamber). Electron emission regions are formed on the first substrate together with driving electrodes for controlling the electron emission of the electron emission regions. Phosphor layers are formed on the second substrate together with an anode electrode for effectively accelerating the electrons emitted from the first substrate toward the phosphor layers to thereby emit light and/or display an image.

With the FEA-type electron emission device, cathode and gate electrodes are formed on the first substrate as the driving electrodes. The cathode electrodes are electrically connected to the electron emission regions to supply electric currents to the electron emission regions. Electric fields are formed around the electron emission regions using a voltage difference between the gate electrodes and the cathode electrodes, thereby inducing the electron emission. The cathode and gate electrodes are insulated from each other by an insulating layer disposed therebetween.

With the FEA-type electron emission device, the insulating layer may be formed either with a thickness of 1 μm or less using a process referred to as a thin film process, such as a deposition process; or with a thickness of 1 μm or more using a process referred to as a thick film process, such as a screen printing process, a doctor blade process, and/or a laminating process.

In the thin film process case, a micro-pixel may be easily formed. However, with the thin insulating layer formed through the thin film process, as the height of the gate electrodes with respect to the electron emission regions is lowered (due the thinness of the insulating layer formed through the thin film process), an electric field due to a high voltage applied to the anode electrode (referred to hereinafter simply as an anode electric field) may directly influence the electron emission regions.

Accordingly, in the above thin film process case, electrons may be emitted from the electron emission regions to pixels that should have been turned off with the driving of the electron emission device due to the influence of the anode electric field, thereby emitting unwanted light through the phosphor layers of the pixels. Consequently, in the electron emission device with the thin insulating layer formed through the thin film process, a high voltage should not be applied to the anode electrode, thereby limiting the intensity of a screen luminance.

In the thick film process case, the gate electrodes may be formed at a plane higher than the electron emission regions to thereby reduce the spread of electron beams so that the misoperation of the device due to the anode electric field can be prevented, but the thick insulating layer formed through the thick film process can result in the formation of a parasitic capacitance between the cathode electrodes and the gate electrodes due to the high dielectric constant of the insulating layer. Therefore, in the electron emission device with the thick insulating layer, the driving signals can be easily distorted due to the parasitic capacitance of the thick insulating layer so that it becomes difficult to correctly drive the respective pixels.

SUMMARY OF THE INVENTION

In one exemplary embodiment of the present invention, there is provided an electron emission device which has a thick insulating layer to electrically insulate the driving electrodes from each other in an appropriate manner, and to inhibit the signal distortion due to a parasitic capacitance of the insulating layer, thereby enhancing the electrical operation characteristic of the electron emission device.

In one embodiment, the electron emission device includes first and second substrates facing each other with a predetermined distance therebetween, and an electron emission region formed on the first substrate. First and second electrodes are placed on the first substrate while being insulated from each other to control an electron emission of the electron emission region. An insulating layer is disposed between the first and second electrodes. An anode electrode is formed on the second substrate. A phosphor layer is formed on a surface of the anode electrode. The insulating layer has a multiple-layered structure including at least two layers differing from each other in electro-physical property.

The insulating layer has at least two layers of the insulating layer differing from each other in specific resistance. The insulating layer has a first layer, and a second layer formed on a surface of the first layer, the second layer having a second specific resistance, the first layer having a first specific resistance, the second specific resistance being lower than the first specific resistance.

The insulating layer has a thickness of 2 μm or more, and the second layer has a specific resistance from $10^5$ to $10^{12}$ Ωcm. The thickness of the second layer is established to be at most ½ the total thickness of the insulating layer.

In another embodiment, the electron emission device includes first and second substrates facing each other with a distance therebetween, and first, second and third electrodes formed on the first substrate while being placed at different planes. An electron emission region is electrically connected to the first electrode. A lower insulating layer is disposed between the first and second electrodes. An upper insulating layer is disposed between one of the first and second electrodes and the third electrode. A phosphor layer is formed on the second substrate. An anode electrode is formed on a surface of the phosphor layer. Each of the lower insulating layer and the upper insulating layer has a multiple-layered structure including at least two layers differing from each other in electro-physical property.

The at least two layers of each of the lower insulating layer and the upper insulating layer differ from each other in specific resistance. That is, each of the lower insulating layer and the upper insulating layer has a first layer and a second layer formed on a surface of the first layer, the second layer having a second specific resistance, the first layer having a first specific resistance, the second specific resistance being lower than the first specific resistance. The second layer of the upper insulating layer is in one embodiment placed on an upper surface of the first layer of the upper insulating layer.

Each of the lower insulating layer and the upper insulating layer has a thickness of 2 μm or more. Each of the second layer of the lower insulating layer and the second layer of the upper insulating layer has a specific resistance from $10^5$ to $10^{12}$ Ωcm. The thickness of the second layer of the lower insulating layer is established to be at most ½ the total thickness of the lower insulating layer, and the thickness of the second layer of the upper insulating layer is established to be at most ½ the total thickness of the upper insulating layer.

DETAILED DESCRIPTION

In the present application, when a first part is referred to as being on a second part, the first part may be directly on the second part or indirectly on the second part via a third part.

Figure 1:
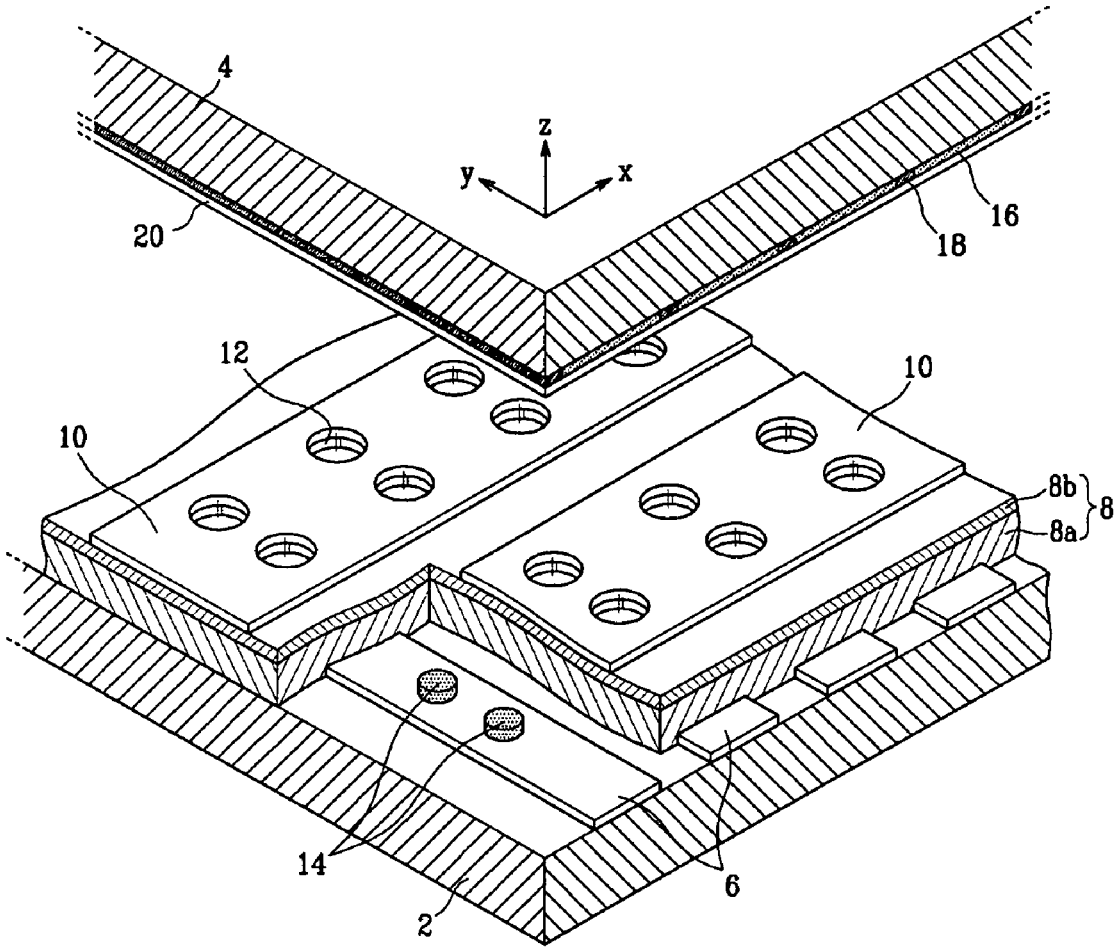
FIG. 1 is a partial exploded perspective view of an electron emission device according to a first embodiment of the present invention.
Figure 2:
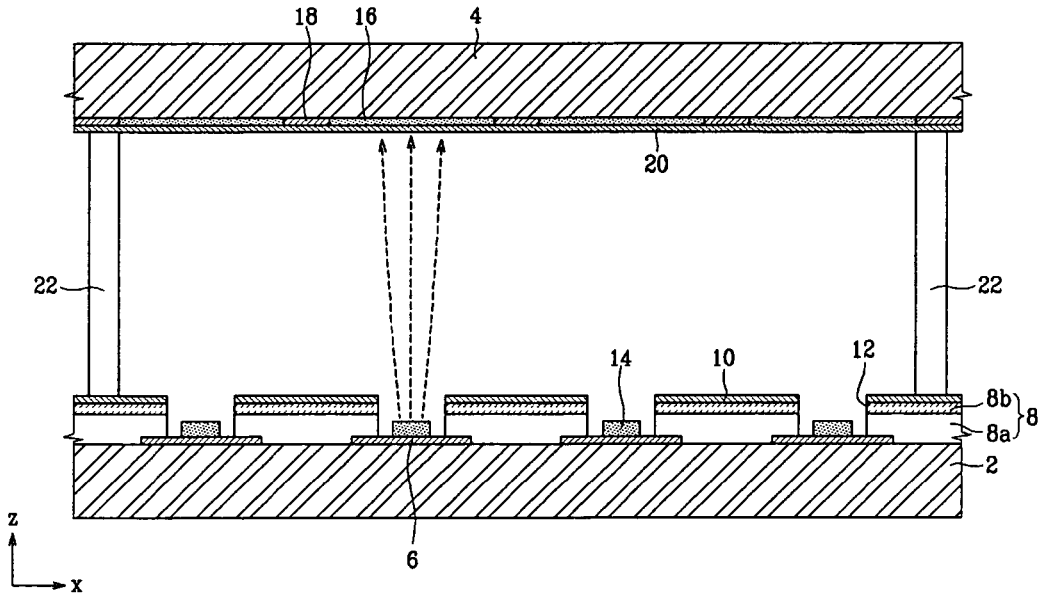
FIG. 2 is a partial sectional view of the electron emission device according to the first embodiment of the present invention.

As shown in FIG. 1 and FIG. 2, the electron emission device of the first embodiment includes first and second substrates 2 and 4 spaced apart from each other in parallel with a predetermined distance therebetween. An electron emission structure is provided at the first substrate 2 to emit electrons, and a light emission or image display structure at the second substrate 4 to emit visible rays due to the electrons.

A plurality of cathode electrodes 6 are arranged on the first substrate 2 as first electrodes. The cathode electrodes 6 are stripe-patterned in a first direction of the first substrate 2, while being spaced apart from each other with a distance therebetween. An insulating layer 8 is formed on the entire surface of the first substrate 2 while covering the cathode electrodes 6.

A plurality of gate electrodes 10 are formed on the insulating layer 8 as second electrodes. The gate electrodes 10 are stripe-patterned in a second direction, perpendicular to the first direction of the cathode electrodes 6, while being spaced apart from each other with a distance therebetween.

In this embodiment, when the crossed regions of the cathode and the gate electrodes 6 and 10 are defined as pixel regions, one or more openings 12 are formed at the gate electrode 6 and the insulating layer 8 per the respective pixel regions while partially exposing the cathode electrode 6. Electron emission regions 14 are formed on the cathode electrodes 6 within the openings 12. The electron emission regions 14 are electrically connected to the cathode electrodes 6.

The electron emission regions 14 are formed with a material for emitting electrons under the application of an electric field, such as a carbonaceous material and/or a nanometer-sized material. In one embodiment, the electron emission regions 14 are formed using carbon nanotube, graphite, graphite nanofiber, diamond, diamond-like carbon, $C_{60}$, and/or silicon nanowire, by way of screen-printing, direct growth, chemical vapor deposition, and/or sputtering.

It is illustrated in FIG. 1 that the electron emission regions 14 are circular in shape, and linearly arranged along the length of the cathode electrodes 6 at the respective pixel regions. However, the plane shape, the number per pixel, and the arrangement of the electron emission regions 14 are not limited to the illustration, and may be altered in various manners.

Referring still to FIGS. 1 and 2, the insulating layer 8 is disposed between the cathode and gate electrodes 6 and 10 to electrically insulate them from each other. In this embodiment, the insulating layer 8 has a double-layered structure. The double-layered structure includes first and second layers 8*a* and 8*b* that differ from each other in electro-physical property. Specifically, in one embodiment, the double-layered structure of the insulating layer 8 is formed with the first and second layers 8*a* and 8*b* that differ from each other in specific resistance.

With the difference in specific resistance, one of the first and second layers 8*a* and 8*b* can substantially function as an insulating layer, while the other layer can function as a resistance layer with a specific resistance lower than that of the former layer.

Specifically, in one embodiment, the insulating layer 8 has the first layer 8*a* formed with a common insulating material such as glass frit, and the second layer 8*b* formed on the first layer 8*a* with a material having a specific resistance from $10^5$ to $10^{12}$ Ωcm. The first layer 8*a* is substantially functioning as the insulating layer, and the second layer 8*b* lowers the capacitance of the insulating layer 8 at the crossed regions of the cathode and the gate electrodes 6 and 10 due to the specific resistance characteristic thereof.

The specific resistance of the second layer 8*b* is considerably higher than that of the conductive material forming the gate electrodes 10, and the electrical insulation of the gate electrodes 10 contacting the second layer 8*b* is achieved to be at the same degree as with the conventional insulating layer. For reference, with the main materials for the gate electrodes 10 being formed with aluminum (Al) and/or molybdenum (Mo), aluminum has a specific resistance of $2.65\times10^{-6}$ Ωcm, and molybdenum has a specific resistance of $5.7\times10^{-6}$ Ωcm.

The insulating layer 8 is formed through a thick film process, such as a screen printing process, a doctor blade process, and/or a laminating process. The insulating layer 8 in one embodiment has a thickness of 1 μm or more, and more particularly has a thickness of 2 μm or more. The thickness of the second layer 8*b* functions as a resistance layer, and is in one embodiment established to be at most ½ the total thickness of the insulating layer 8 (e.g., 1 μm or less) such that the second layer 8*b* does not distort the insulation characteristic of the insulating layer 8.

With the above-identified thickness of the insulating layer 8, the gate electrodes 10 have a sufficient height with respect to the electron emission regions 14, and during the driving of the electron emission device, the gate electrodes 10 partially shield the influence of the anode electric field to the electron emission regions 14.

Figure 3:
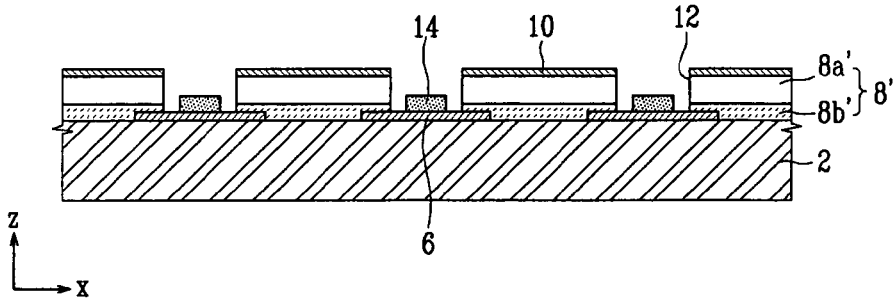
FIG. 3 is a partial sectional view of an electron emission device according to a second embodiment of the present invention.

As shown in FIGS. 1 and 2, the second layer 8*b* of the insulating layer 8 may be placed over the first layer 8*a;* or as shown in FIG. 3 according to a second embodiment of the present invention, a second layer 8*b*' of an insulating layer 8' is placed under a first layer 8*a*' of the insulating layer 8'. Although not illustrated in the drawings, a second layer may be placed over a first layer as well as under the first layer.

Referring now back to FIGS. 1 and 2, with the structure where the second layer 8*b* is placed over the first layer 8*a,* the second layer 8*b* prevents the electrons from being accumulated on the insulating layer 8, thereby preventing electron mis-discharging due to the cumulated electrons.

Phosphor layers 16 and black layers 18 are formed on a surface of the second substrate 4 facing the first substrate 2. An anode electrode 20 is formed on the phosphor layers 16 and the black layers 18 with a metallic material, such as aluminum. The anode electrode 20 receives a high voltage required for accelerating the electron emission structure toward the phosphor layers 16 electron beams, and reflects the visible rays radiated from the phosphor layers 16 to the first substrate 2 toward the second substrate 4, thereby further heightening the screen luminance.

Alternatively, the anode electrode may be formed with a transparent conductive material, such as indium tin oxide (ITO), instead of the metallic material. In this case, the anode electrode (not shown) is placed on the surface of the phosphor layers and the black layers facing the second substrate. The electrode being partitioned into a plurality of separate portions with a predetermined pattern, or formed on the entire surface at the second substrate.

The first and second substrates 2 and 4 are sealed with each other with a predetermined distance therebetween using a sealant (not shown) such that the gate electrodes 10 face the anode electrode 20. The inner space between the first and second substrates 2 and 4 is exhausted to be in a vacuum state, thereby constructing an electron emission device. A plurality of spacers 22 are arranged at the non-light emission area between the first and second substrates 2 and 4 to space them from each other with the predetermined distance.

The above-structured electron emission device is driven by supplying predetermined voltages to the cathode electrodes 6, the gate electrodes 10, and the anode electrode 20 from the outside. For instance, a plus (+) direct current (DC) voltage of several hundred to several thousand volts is applied to the anode electrode 20. Scan signals are applied to the gate electrodes 10, and data signals are applied to the cathode electrodes 6. The turning on and the turning off of the respective pixels are controlled using the voltage difference between the cathode and gate electrodes 6 and 10.

Electric fields are formed around the electron emission regions 14 at the pixels where the voltage difference between the cathode and gate electrodes 6 and 10 exceeds a threshold value, and electrons are emitted from these electron emission regions 14. The emitted electrons are attracted by the high voltage applied to the anode electrode 20, and are directed to collide against the phosphor layers 16 at the relevant pixels to thereby emit light.

In the electron emission device according to the first embodiment and with the above driving process, as the insulating layer 8 has the second layer 8*b* with the specific resistance from $10^5$ to $10^{12}$ Ωcm, the capacitance inevitably formed at the insulating layer 8 corresponding to the crossed regions of the cathode and gate electrodes 6 and 10 is lowered, thereby inhibiting a distortion of the driving signals. As a result, with the electron emission device according to the present embodiment, the respective pixels are correctly driven, thereby enhancing the display characteristic.

Figure 4:
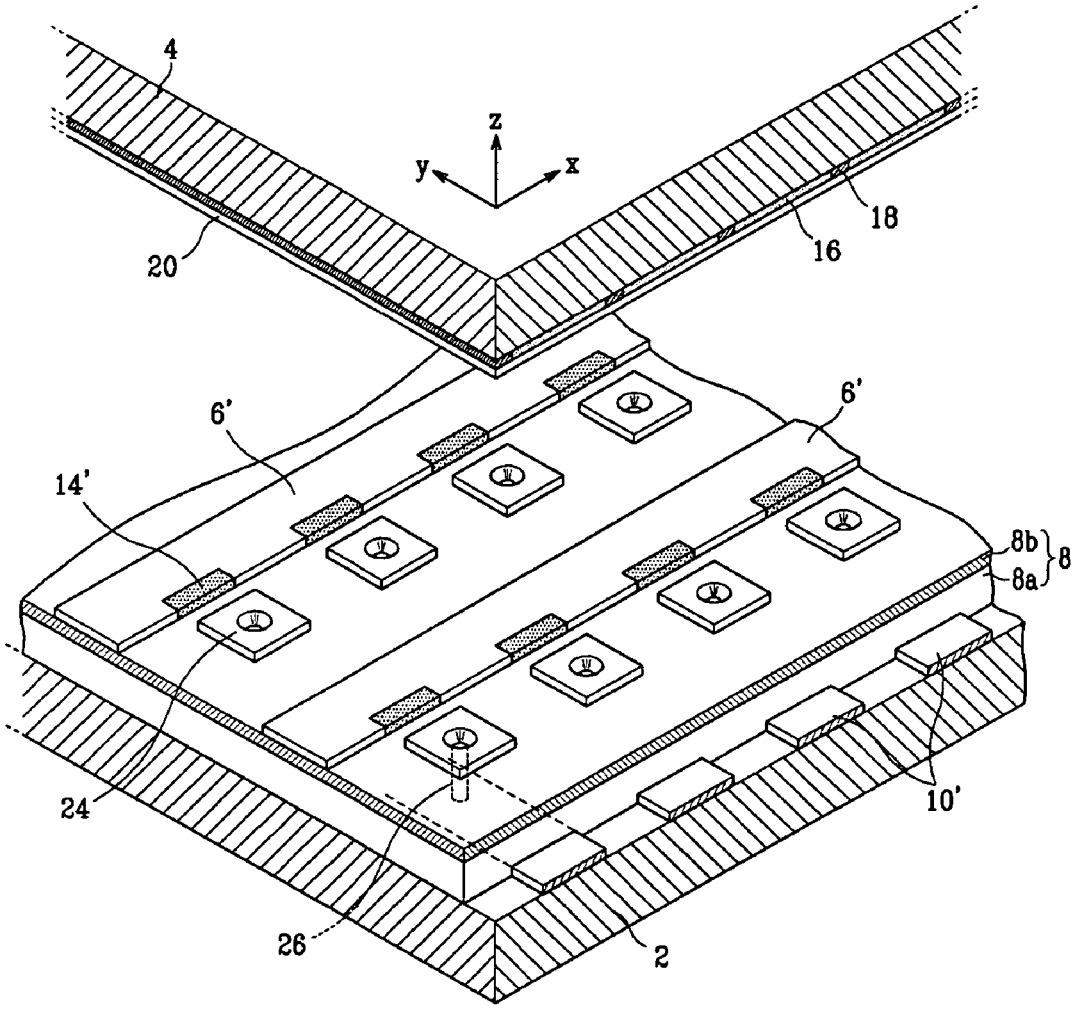
FIG. 4 is a partial exploded perspective view of an electron emission device according to a third embodiment of the present invention.
Figure 5:
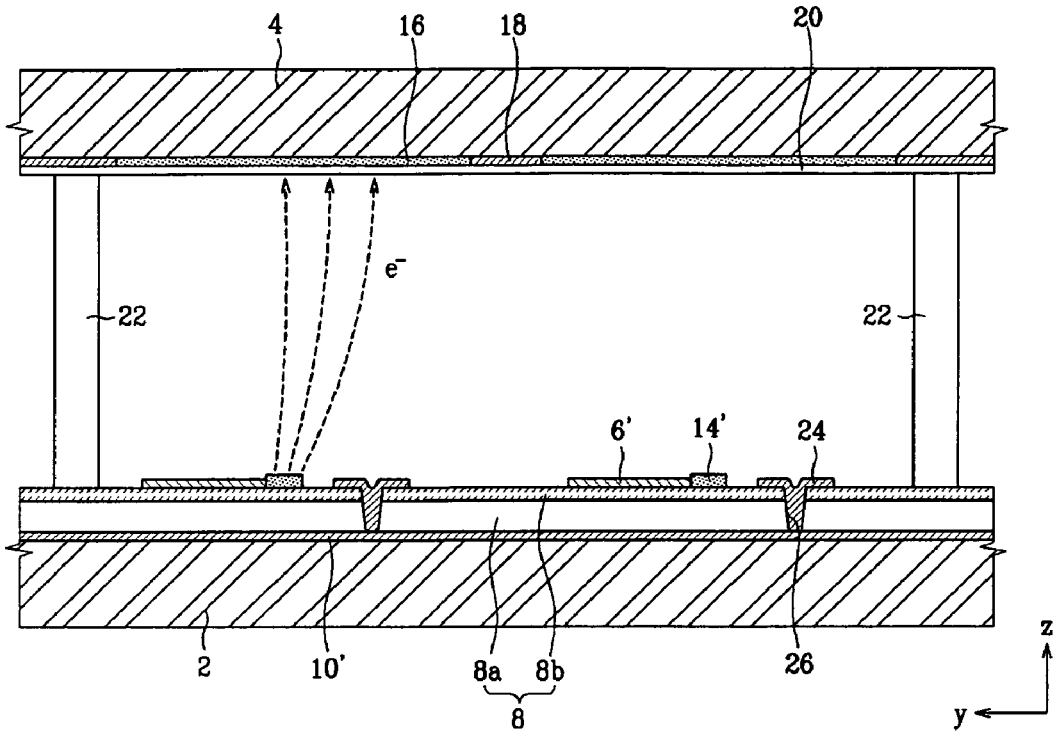
FIG. 5 is a partial sectional view of the electron emission device according to the third embodiment of the present invention.

FIG. 4 is a partial exploded perspective view of an electron emission device according to a third embodiment of the present invention, and FIG. 5 is a partial sectional view of the electron emission device, illustrating the combination state thereof.

As shown in the drawings, with the electron emission device according to the third embodiment of the present invention, gate electrodes 10' being a plurality of second electrodes, an insulating layer 8 having a double-layered structure with first and second layers 8*a* and 8*b,* and cathode electrodes 6' being a plurality of first electrodes are sequentially formed on a first substrate 2.

The gate and cathode electrodes 10' and 6' are stripe-patterned and perpendicular to each other, and electron emission regions 14' are formed at the one-sided periphery of a cathode electrode 6' corresponding to respective pixel regions such that at least one lateral side of an electron emission region 14' is surrounded by the cathode electrode 6'.

Counter electrodes 24 are formed on the first substrate 2 to pull the electric field of the gate electrodes 10' through the insulating layer 8. The counter electrodes 24 are spaced apart from the electron emission regions 14' with a distance therebetween while being disposed between the cathode electrodes 6', and are electrically connected to the gate electrodes 10' through holes (or vias) 26 formed at the insulating layer 8. Similar to the electron emission regions 14', the counter electrodes 24 are provided corresponding to the pixel regions defined on the first substrate 2.

With the electron emission device at FIGS. 4 and 5, scan signals are applied to the cathode electrodes 6', and data signals are applied to the gate electrodes 10' such that the turning on and off of the respective pixels can be controlled using the voltage difference between the cathode and gate electrodes 6' and 10'.

Accordingly, electric fields are formed around the electron emission regions 14' at the pixels where the voltage difference between the cathode and the gate electrodes 6' and 10' exceeds a threshold value, from the bottom of the electron emission regions 14' where the gate electrodes 10' are located, and from the lateral sides of the electron emission regions 14' where the counter electrodes 24 are located. Electrons are emitted from the electron emission regions 14', and attracted by a high voltage applied to the anode electrode 20, thereby colliding against the phosphor layers 16 at the relevant pixels.

Figure 6:
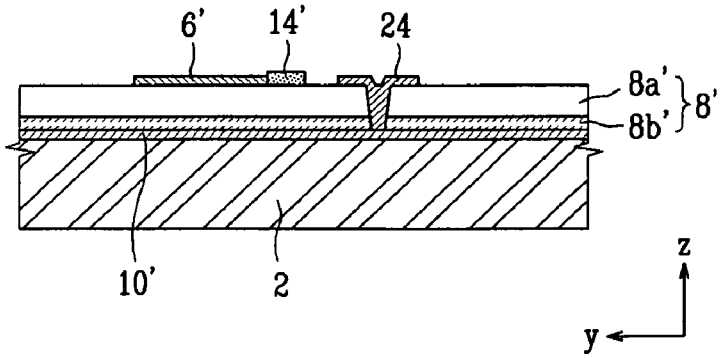
FIG. 6 is a partial sectional view of an electron emission device according to a fourth embodiment of the present invention.

In the electron emission device of FIGS. 4 and 5, and during the above driving process, the second layer 8*b* functioning as the resistance layer lowers the capacitance of the insulating layer 8, thereby inhibiting the distortion of the driving signals. As shown in FIGS. 4 and 5, the second layer 8*b* may be placed over the first layer 8*a;* or as shown in FIG. 6 according to a fourth embodiment of the present invention, a second layer 8*b'* of an insulating layer 8' is placed under a first layer 8*a* of the insulating layer 8'. Furthermore, although not illustrated, a second layer may be placed over a first layer as well as under the first layer.

Figure 7:
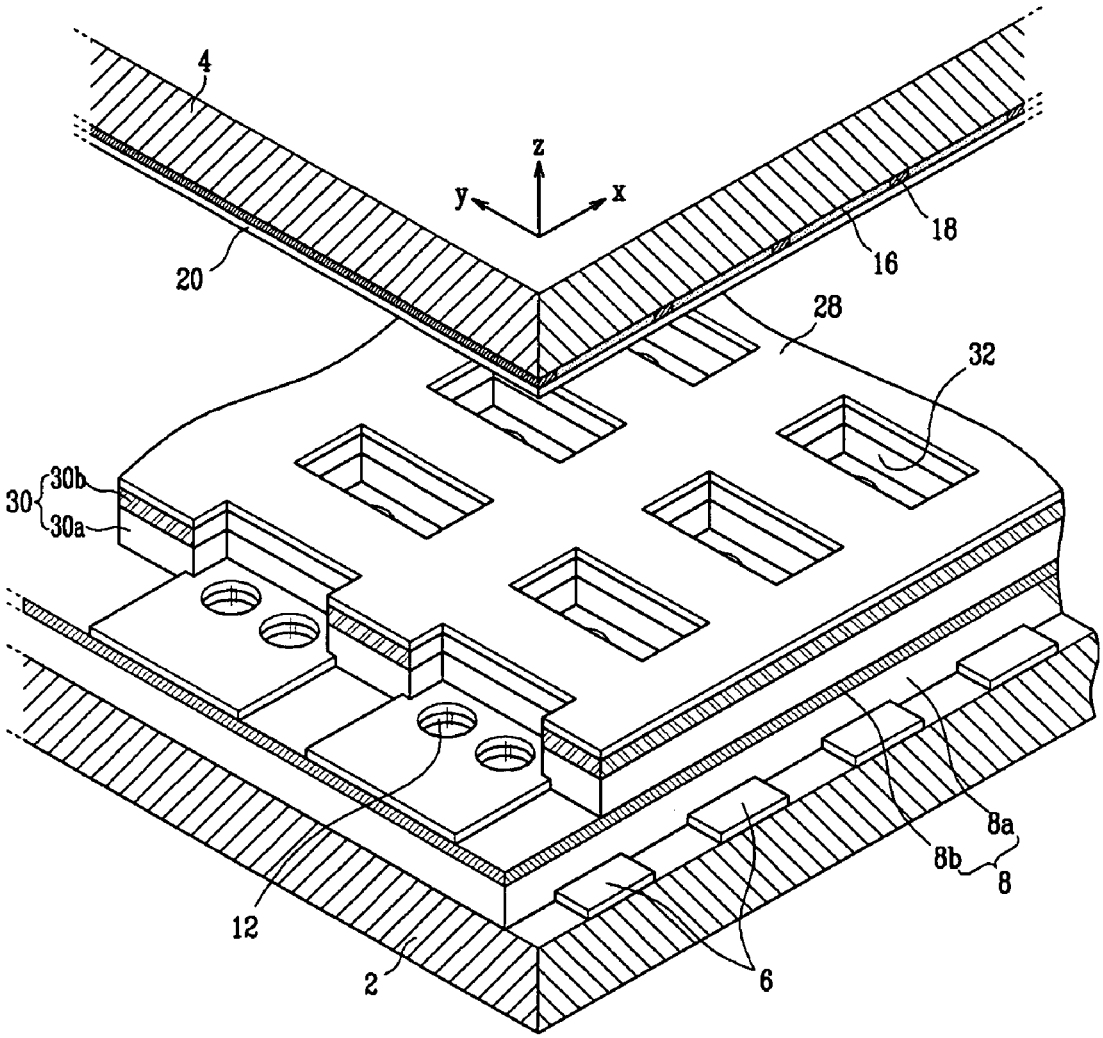
FIG. 7 is a partial exploded perspective view of an electron emission device according to a fifth embodiment of the present invention.
Figure 8:
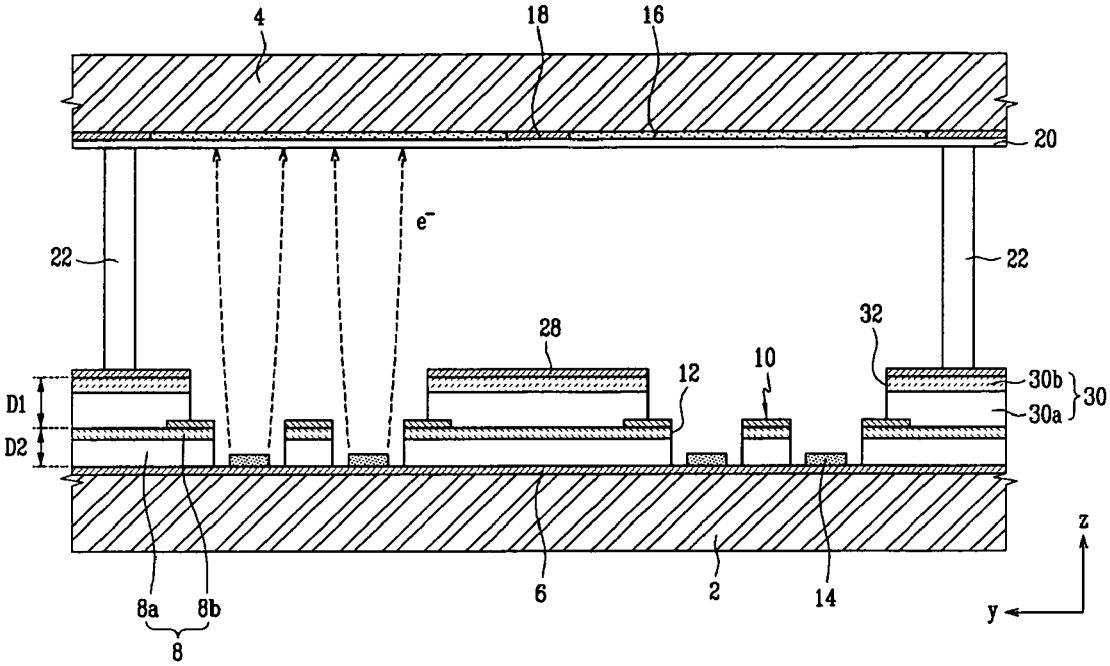
FIG. 8 is a partial sectional view of the electron emission device according to the fifth embodiment of the present invention.

FIG. 7 is a partial exploded perspective view of an electron emission device according to a fifth embodiment of the present invention, and FIG. 8 is a partial sectional view of the electron emission device, illustrating the combination state thereof.

As shown in the drawings, the basic structural components of the electron emission device according to the fifth embodiment of the present invention are substantially the same as those shown and/or described for the first embodiment except that a focusing electrode 28 is formed over the gate electrodes 10 as a third electrode. An insulating layer 30 is disposed between the gate electrodes 10 and the focusing electrode 28 to electrically insulate them from each other. An insulating layer 8 disposed between the cathode and gate electrodes 6 and 10 is hereinafter referred to as a lower insulating layer, and the insulating layer 30 disposed between the gate and focusing electrodes 10 and 28 is hereinafter referred to as the upper insulating layer.

Openings 32 are formed at the focusing electrode 28 and the upper insulating layer 30 to expose the electron emission regions 14 on the first substrate 2. The openings 32 are provided to the pixel regions, respectively, such that the focusing electrode 28 collectively focuses the electrons emitted at each pixel region. The focusing electrode 28 may be formed on the entire surface of the first substrate 2, or partitioned into a plurality of separate portions with a predetermined pattern. In the latter case, the illustration thereof is not shown.

In this embodiment, the upper insulating layer 30 also has a double-layered structure with first and second layers 30*a* and 30*b* that differ from each other in specific resistance. The first layer 30*a* is formed with a common insulating material such as glass frit, and the second layer 30*b* in one embodiment has a specific resistance from $10^5$ to $10^{12}$ Ωcm. Therefore, the first layer 30*a* substantially functions as an insulating layer disposed between the gate and focusing electrodes 10 and 28, and the second layer 30*b* lowers the capacitance of the upper insulating layer 30, thereby inhibiting a signal distortion.

The upper insulating layer 30 is also formed through a thick film process, such as a screen printing process, a doctor blade process, and/or a laminating process. The upper insulating layer 30 in one embodiment has a thickness of 1 μm or more, and more particularly has a thickness of 2 μm or more. The thickness of the upper insulating layer 30 (D1, as shown in FIG. 8) is in one embodiment established to be larger than the thickness of the lower insulating layer 8 (D2, as shown in FIG. 8) such that the focusing electrode 28 has a sufficient height with respect to the electron emission regions 14.

In addition, the thickness of the second layer 30*b* of the upper insulating layer 30 is in one embodiment established to be at most ½ the total thickness of the upper insulating layer 30.

Furthermore, the second layer 30*b* of the upper insulating layer 30 is in one embodiment placed over the first layer 30*a*. In this case, the focusing electrode 28 is electrically thickened due to the low specific resistance characteristic of the second layer 30*b* as compared to the first layer 30*a*. Therefore, the focusing capacity of the focusing electrode 28 is heightened, and the influence of the anode electric field with respect to the electron emission regions 14 is effectively shielded, thereby constructing a high-efficiency electron emission device. For this purpose, the second layer 30*b* of the upper insulating layer 30 has a thickness larger than the second layer 8*b* of the lower insulating layer 8.

Figure 9:
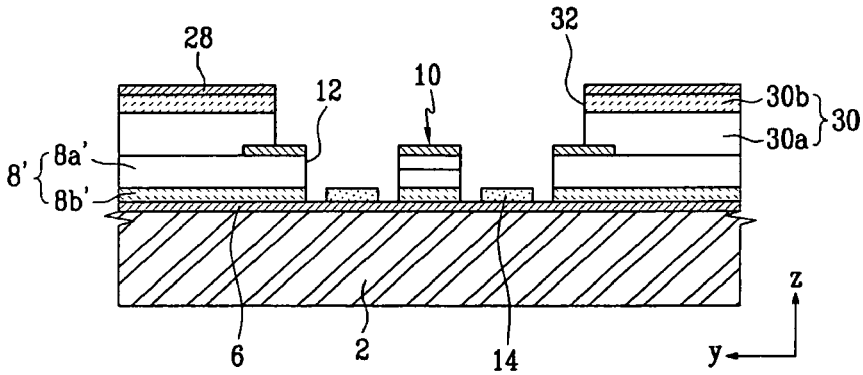
FIG. 9 is a partial sectional view of an electron emission device according to a sixth embodiment of the present invention.

Meanwhile, as shown in FIGS. 7 and 8, the second layer 8*b* of the lower insulating layer 8 may be placed over the first layer 8*a* of the lower insulating layer 8; or as shown in FIG. 9 according to a sixth embodiment of the present invention, a second layer 8*b'* of a lower insulating 8' is placed under a first layer 8*a'* of the lower insulating layer 8'. Although not illustrated in the drawings, a second layer of a lower insulating layer may be placed over a first layer of the lower insulating layer, as well as under the first layer thereof.

A minus (−) direct current (DC) voltage of several to several ten volts is applied to the focusing electrode 28 to focus the electrons emitted from the electron emission regions 14 during the operation of the electron emission device, thereby minimizing the spreading of electron beams.

Figure 10:
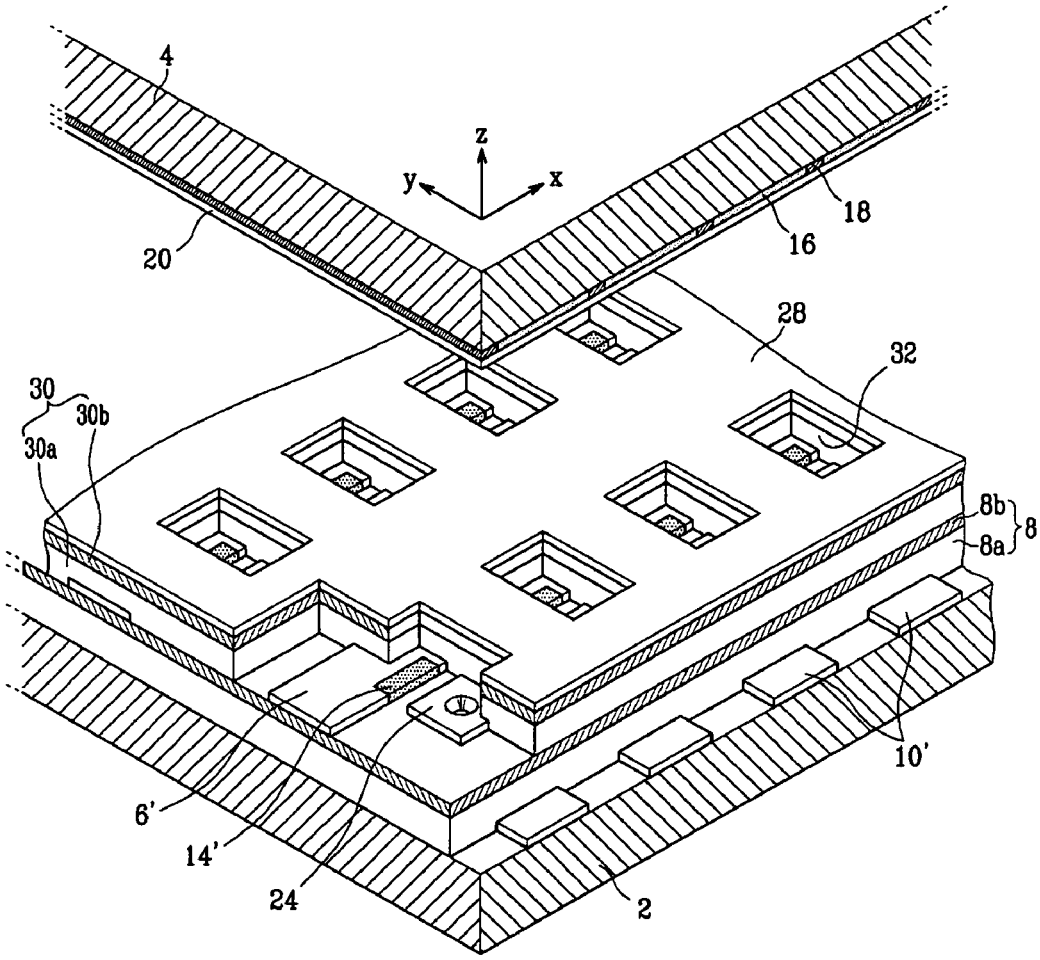
FIG. 10 is a partial exploded perspective view of an electron emission device according to a seventh embodiment of the present invention.
Figure 11:
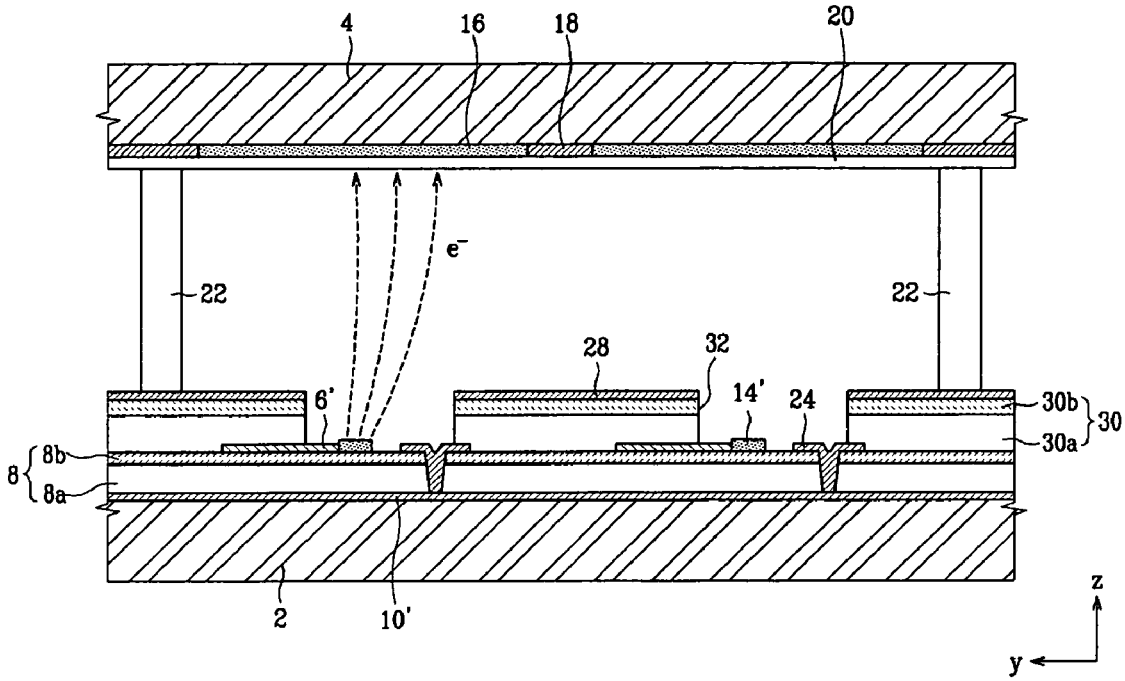
FIG. 11 is a partial sectional view of the electron emission device according to the seventh embodiment of the present invention.

FIG. 10 is a partial exploded perspective view of an electron emission device according to a seventh embodiment of the present invention, and FIG. 11 is a partial sectional view of the electron emission device, illustrating the combination state thereof.

As shown in the drawings, the basic structural components of the electron emission device according to the seventh embodiment of the present invention are substantially the same as those shown and/or described for the third embodiment except that a focusing electrode 28 is formed over the cathode electrodes 6' as a third electrode. An upper insulating layer 30 is disposed between the cathode electrodes 6' and the focusing electrode 28 to electrically insulate them from each other.

The upper insulating layer 30 and the focusing electrode 28 also have openings 32 exposing the electron emission regions 14' on the first substrate 2. The openings 32 are provided corresponding to the electron emission regions 14', respectively. The focusing electrode 28 may be formed on the entire surface of the first substrate 2, or partitioned into a plurality of separate portions with a predetermined pattern. In the latter case, the illustration thereof is not shown.

The upper insulating layer 30 has a double-layered structure with first and second layers 30*a* and 30*b* that differ from each other in specific resistance. The first layer 30*a* is formed with a common insulating material such as glass frit, and the second layer 30*b* in one embodiment has a specific resistance from $10^5$ to $10^{12}$ Ωcm. Therefore, the first layer 30*a* substantially functions as an insulating layer disposed between the cathode and focusing electrodes 6' and 28, and the second layer 30*b* lowers the capacitance of the upper insulating layer 30, thereby inhibiting a signal distortion.

An insulating layer 8 is disposed between the gate and the cathode electrodes 10' and 6' and is hereinafter referred to as a lower insulating layer. Each of the lower and upper insulating layers 8 and 30 has a thickness of 1 μm or more, and more particularly has a thickness of 2 μm or more. The thickness of the upper insulating layer 30 is in one embodiment established to be larger than the thickness of the lower insulating layer 8 such that the focusing electrode 28 has a sufficient height with respect to the electron emission regions 14'.

In order for the focusing electrode 28 to be electrically thickened, the second layer 30*b* of the upper insulating layer 30 is placed over the first layer 30*a* of the upper insulating layer 30. The thickness of the second layer 30*b* of the upper insulating layer 30 is in one embodiment established to be at most ½ the total thickness of the upper insulating layer 30, and the thickness of the second layer 8*b* is in one embodiment established to be at most ½ the total thickness of the lower insulating layer 8.

Figure 12:
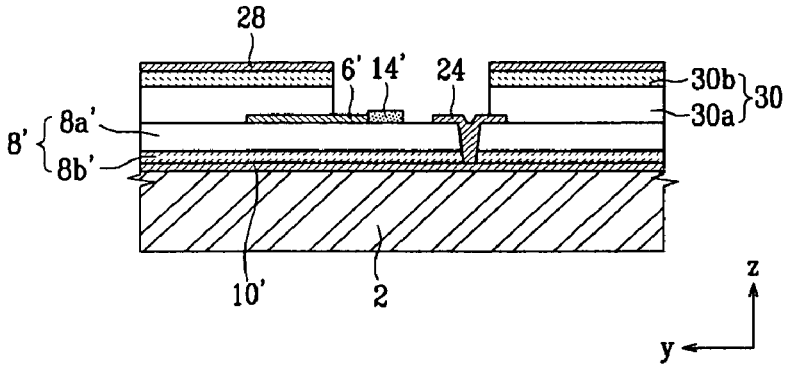
FIG. 12 is a partial sectional view of an electron emission device according to an eighth embodiment of the present invention.

As shown in FIGS. 10 and 11, the second layer 8*b* of the lower insulating layer 8 may be placed over the first layer 8*a* of the lower insulating layer 8; or as shown in FIG. 12 according to an eighth embodiment of the present invention, a second layer 8*b'* of a lower insulting layer 8' is placed under a first layer 8*a'* of the lower insulating layer 8'. Although not illustrated in the drawings, a second layer of a lower insulating layer may be placed over a first layer of the lower insulating layer, as well as under the first layer thereof.

As described above, in an electron emission device according to the present invention, a capacitance of an insulating layer is lowered at crossed regions of first and second electrodes and/or at crossed regions of the second electrodes and a third electrode, thereby inhibiting a distortion of driving signals. Accordingly, with the electron emission device, the respective pixels of the electron emission device are correctly driven, thereby enhancing the display characteristics.

In case a second layer of an insulating layer is placed over a first layer thereof, a problematic accumulation of electrons at the insulating layer can be prevented, and the mis-discharging pursuant thereto can also be prevented. Furthermore, in case a focusing electrode is provided, and a second layer of an upper insulating layer is placed over a first layer thereof, the focusing electrode is electrically thickened to efficiently shield the electron emission regions from the influence of the anode electric field, thereby enabling the construction of a high-efficiency electron emission device.

Also, while the certain embodiments of the present invention are explained above in relation to the FEA-type electron emission device where the electron emission regions are formed with a material emitting electrons when an electric field is applied under a vacuum atmosphere, the structure of the present invention is not limited to the FEA-type electron emission device, and may be applied to other-type electron emission devices where the driving electrodes are placed at different planes while an insulating layer is interposed between at least two of the different planes.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission device comprising:

first and second substrates facing each other with a distance therebetween;

an electron emission region on the first substrate;

a first electrode and a second electrode on the first substrate while being insulated from each other to control an electron emission of the electron emission region;

an insulating layer between the first and second electrodes;

an anode electrode on the second substrate; and a phosphor layer on a surface of the anode electrode;

wherein the insulating layer has a multiple-layered structure comprising a first layer having a first specific resistance higher than a second specific resistance and a second layer having the second specific resistance, the first layer physically contacting one of the first electrode or the second electrode, the second layer physically contacting the other one of the first electrode or the second electrode, and wherein the second layer has a specific resistance from $10^5$to $10^{12}$Ωcm.

2. The electron emission device of claim 1, wherein the second layer is on a surface of the first layer.

3. The electron emission device of claim 2, wherein the insulating layer has a thickness of 2μm or more.

4. The electron emission device of claim 3, wherein the thickness of the second layer having the second specific resistance lower than the first specific resistance is at most ½ the thickness of the insulating layer.

5. The electron emission device of claim 1, wherein the first electrode and the second electrode are placed at two different planes, while the insulating layer is interposed between the two different planes.

6. The electron emission device of claim 5, wherein the electron emission region is electrically connected to one of the first electrode or the second electrode.

7. An electron emission device comprising: first and second substrates facing each other with a distance therebetween;

a first electrode, a second electrode, and a third electrode on the first substrate while being placed at different planes, respectively;

an electron emission region electrically connected to the first electrode;

a lower insulating layer between the first and second electrodes;

an upper insulating layer between one of the first electrode or the second electrode and the third electrode;

a phosphor layer on the second substrate; and an anode electrode on a surface of the phosphor layer;

wherein the lower insulating layer has a first multiple-layered structure comprising a first layer having a first specific resistance higher than a second specific resistance and a second layer having the second specific resistance, the first layer physically contacting one of the first electrode or the second electrode, the second layer physically contacting the other one of the first electrode or the second electrode, wherein the upper insulating layer has a second multiple-layered structure comprising a third layer having a third specific resistance higher than a fourth specific resistance and a fourth layer having the fourth specific resistance, the third layer physically contacting one of the first electrode, the second electrode, or the third electrode, wherein each of the second layer of the lower insulating layer and the fourth layer of the upper insulating layer has a specific resistance from $10^5$ to $10^{12}\Omega$cm.

8. The electron emission device of claim 7, wherein the second layer is on a surface of the first layer, and the fourth layer is on a surface of third layer.

9. The electron emission device of claim 8, wherein each of the lower insulating layer and the upper insulating layer has a thickness of 2μm or more.

10. The electron emission device of claim 9, wherein the thickness of the second layer of the lower insulating layer having the second specific resistance lower than the first specific resistance is at most ½ the thickness of the lower insulating layer.

11. The electron emission device of claim 9, wherein the thickness of the fourth layer of the upper insulating layer having the fourth specific resistance lower than the third specific resistance is at most ½ the thickness of the upper insulating layer.

12. The electron emission device of claim 8, wherein the upper insulating layer is thicker than the lower insulating layer.

13. The electron emission device of claim 8, wherein the fourth layer of the upper insulating layer is thicker than the second layer of the lower insulating layer.

14. The electron emission device of claim 7, wherein the first electrode, the lower insulating layer, the second electrode, the upper insulating layer, and the third electrode are sequentially placed on the first substrate.

15. The electron emission device of claim 7, wherein the second electrode, the lower insulating layer, the first electrode, the upper insulating layer, and the third electrode are sequentially placed on the first substrate.

16. The electron emission device of claim 15, further comprising a counter electrode placed substantially at the same plane as the first electrode while electrically contacting the second electrode through the first opening of the lower insulating layer.

17. The electron emission device of claim 7, wherein the third electrode has an opening for passing an electron beam from the electron emission region, and receives a minus (−) voltage for focusing the electron beam.

18. An electron emission device comprising:

first and second substrates facing each other with a distance therebetween;

a cathode electrode and a gate electrode on the first substrate at two different planes, a lower insulating layer being between the two different planes;

an electron emission region electrically connected to the cathode electrode;

a focusing electrode on the first substrate and over the cathode and gate electrodes, an upper insulating layer being between the focusing electrode and the cathode and gate electrodes;

a phosphor layer on the second substrate; and an anode electrode on a surface of the phosphor layer;

wherein the lower insulating layer has a first multiple-layered structure comprising a first layer having a first specific resistance higher than a second specific resistance and a second layer having the second specific resistance, the first layer physically contacting one of the cathode electrode or the gate electrode, the second layer physically contacting the other one of the cathode electrode or the gate electrode, wherein the upper insulating layer has a second multiple-layered structure comprising a third layer having a third specific resistance higher than a fourth specific resistance and a fourth layer having the fourth specific resistance, the third layer physically contacting one of the cathode electrode, the gate electrode, or the focus electrode, and wherein the second layer is on a surface of the first layer, and the fourth layer is on a surface of third layer, the second layer having a specific resistance from $10^5$to $10^{12}\Omega$cm, the fourth layer having a specific resistance from $10^5$to $10^{12}\Omega$cm.

19. The electron emission device of claim 18, wherein each of the lower insulating layer and the upper insulating layer has a thickness of 2μm or more, and each of the second layer of the lower insulating layer having the second specific resistance lower than the first specific resistance and the fourth layer of the upper insulating layer having the fourth specific resistance lower than the third specific resistance has a thickness of 1 μm or less.

20. The electron emission device of claim 18, wherein the fourth layer of the upper insulating layer physically contacts the focusing electrode.

21. The electron emission device of claim 18, wherein the electron emission region is a non-tipped electron emission region and comprises a material selected from the group consisting of carbon nanotube, graphite, graphite nanofiber, diamond, diamond-like carbon, $C_{60}$, silicon nanowire, and combinations thereof.

22. An electron emission device comprising:

first and second substrates facing each other with a distance therebetween;

an electron emission region on the first substrate;

a first electrode and a second electrode on the first substrate while being insulated from each other to control an electron emission of the electron emission region;

an insulating layer between the first and second electrodes;

an anode electrode on the second substrate; and a phosphor layer on a surface of the anode electrode;

wherein the insulating layer has a multiple-layered structure comprising a first layer having a first specific resistance higher than a second specific resistance and a second layer having the second specific resistance, the first layer physically contacting one of the first electrode or the second electrode, and wherein the second layer has a specific resistance from $10^5$to $10^{12}$ Ωcm.

* * * * *

UNITED STATES PATENT AND TRADEMARK OFFICE

CERTIFICATE OF CORRECTION

PATENT NO. : 7,459,843 B2
APPLICATION NO. : 11/348570
DATED : December 2, 2008
INVENTOR(S) : Seong-Yeon Hwang It is certified that error appears in the above-identified patent and that said Letters Patent is hereby corrected as shown below:

| | |
|---|---|
| Column 11, line 9, Claim 8 | Before "third",<br>Insert --the-- |
| Column 12, line 18, Claim 18 | Before "third",<br>Insert --the-- |

Signed and Sealed this

Nineteenth Day of May, 2009

John Doll

JOHN DOLL
*Acting Director of the United States Patent and Trademark Office*